United States Patent [19]

Kawamura et al.

[11] Patent Number: 4,585,396

[45] Date of Patent: Apr. 29, 1986

[54] TURBINE SHAFT

[75] Inventors: Mitsuyoshi Kawamura; Noboru Ishida, both of Aichi, Japan

[73] Assignee: NGK Spark Plug Co., Ltd., Aichi, Japan

[21] Appl. No.: 556,668

[22] Filed: Nov. 30, 1983

[30] Foreign Application Priority Data

Nov. 30, 1982 [JP] Japan ..... 57-179961[U]

[51] Int. Cl.[4] ..... F02B 17/00; F16N 7/04

[52] U.S. Cl. ..... 416/241 B; 417/407

[58] Field of Search ..... 416/241 B, 244 A; 415/180; 417/407

[56] References Cited

U.S. PATENT DOCUMENTS

| | | | |
|---|---|---|---|
| 2,646,210 | 7/1953 | Kohlmann et al. | 417/407 |
| 2,703,674 | 3/1955 | Wood | 417/407 |
| 3,054,554 | 9/1962 | Buchi | 417/407 |
| 3,961,867 | 6/1976 | Woollenweber | 416/244 A |
| 4,063,850 | 12/1977 | Hueber et al. | 416/241 B |
| 4,279,576 | 7/1981 | Okano et al. | 416/241 B |
| 4,335,998 | 6/1982 | Siebels | 416/241 B |
| 4,349,203 | 9/1982 | Schülke | 416/241 B |
| 4,358,253 | 11/1982 | Okano et al. | 417/407 |
| 4,424,003 | 1/1984 | Brobeck | 416/244 A |
| 4,427,309 | 1/1984 | Blake | 417/407 |

FOREIGN PATENT DOCUMENTS

| | | | |
|---|---|---|---|
| 2211869 | 9/1973 | Fed. Rep. of Germany | 417/407 |
| 3039961 | 6/1982 | Fed. Rep. of Germany | 417/407 |

*Primary Examiner*—Robert E. Garrett

*Attorney, Agent, or Firm*—Sughrue, Mion, Zinn, Macpeak and Seas

[57] ABSTRACT

A turbine having an improved connection between a ceramic rotor and a metal turbine shaft. The juncture between the rotor and the turbine shaft is disposed between a bearing supporting the turbine shaft and a sealing ring isolating the rotor from the oil reservoir of the turbine. A groove is formed at the juncture. Oil is allowed to circulate around the groove at the juncture between the rotor and the shaft, thereby providing a lowered temperature of the juncture, and hence preventing separation between the rotor and shaft due to differences in coefficients of thermal expansion.

5 Claims, 7 Drawing Figures

TURBINE SHAFT

BACKGROUND OF THE INVENTION

The present invention relates to a turbine, such as a gas turbine, turbo-supercharger, or the like. More particularly, the invention pertains to a turbine shaft for use in such an apparatus, and even more specifically, to a connecting portion between a ceramic shaft and a metal shaft of the turbine.

A conventional turbine of the same general type to which the invention pertains is illustrated in FIG. 1 of the drawings. The apparatus includes a turbine casing 5 and a compressor casing 7. A turbine shaft 1 extends longitudinally through the turbine casing 5 into the compressor casing 7. At the end of the turbine shaft 1 inside of the compressor casing 7 a compressor wheel 6 is mounted. An air inlet A is formed in the compressor casing 7 to supply air to the blades of the compressor wheel 6. The turbine shaft 1 is supported by a thrust bearing 10 and a bearing 3. Lubricating oil is supplied through an inlet B and collected in an oil resevoir 13. A lubricating oil outlet C is formed at the bottom of the reservoir 13.

A rotor 2 is mounted on a connecting portion 9 of the turbine shaft 1. A sealing ring 8', fitted in a groove 8, prevents oil from escaping around the turbine wheel 4 and exiting through the gas outlet E in the turbine casing 5. As is conventional, a gas inlet D communicates with the cavity around the rotor 2.

In this arrangement, the neck portion of the rotor 2 receives a large stress due to the relatively large diameter of the connecting portion 9. The larger the diameter of the connecting portion 9, the larger will be the required strength at its juncture with the rotor 2. Furthermore, the large diameter of the connecting portion 9 is disadvantageous in that the bearing speed is proportionally increased.

Recently, due to the very high temperatures present at the outlet, it has been proposed to fabricate the rotor 2 from a ceramic material. In this case, as illustrated in FIG. 2 of the drawings, a straight portion 2*a* of a ceramic rotor 2 is fitted into a cupped end 1*a* of a steel turbine shaft 1. Besides improving the resistance to heat, the weight of the turbine wheel 4 and rotor 2 is decreased, and the responsiveness thereof is hence improved. In such an arrangement, however, manufacturing problems arise. Particularly, heat treatment of the cupped end 1*a*, which must be in contact with a bearing, is difficult. Moreover, if the juncture 12 of the straight portion 2*a* is exposed at the left side of the sealing ring 8', as illustrated in FIG. 3, due to the difference in coefficients of expansion between ceramic and metal materials, it is difficult to maintain the brazed connection between the ceramic and metal members.

Accordingly, it is an object of the present invention to eliminate the above-discussed disadvantages inherent in prior art turbine shafts.

SUMMARY OF THE INVENTION

In accordance with the above and other objects, the invention provides an improved turbine having a ceramic turbine shaft joined to a metal shaft of a rotor in which the connecting portion between the ceramic and metal members is disposed between a bearing and a sealing ring where it is exposed to circulating lubricating oil. A groove is formed at the juncture between the two members. In this arrangement, the connecting portion is not exposed to an excessively high temperature, thereby preventing disconnection between the ceramic and metal members, while allowing the connecting portion to have a relatively large diameter.

DESCRIPTION OF THE PREFERRED EMBODIMENTS

Figure 1:
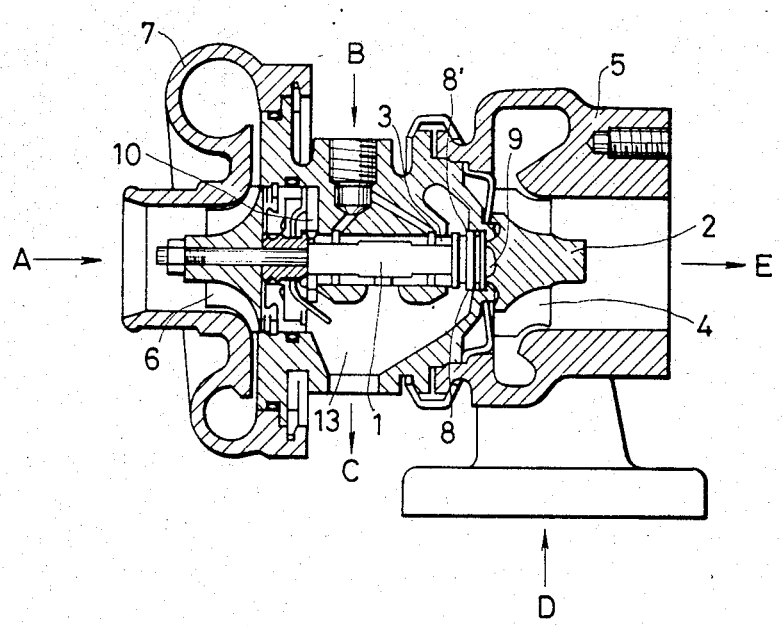
FIG. 1 PRIOR ART
FIG. 1 depicts a conventional turbine, shown partially in cross section.
Figure 2:
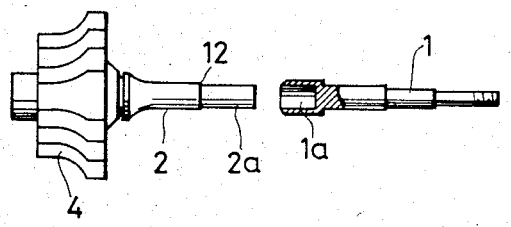
FIG. 2 PRIOR ART
FIG. 2 is a diagram, partially in cross section, illustrating a first prior art approach for joining ceramic and metal shafts in a turbine.
Figure 3:
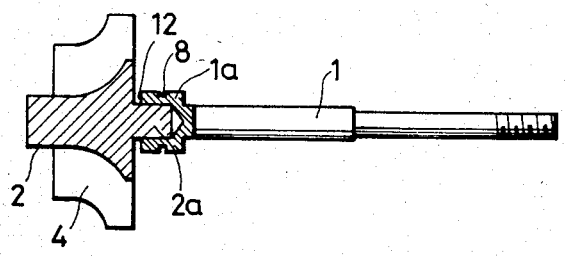
FIG. 3 PRIOR ART
FIG. 3 is a view, similar to FIG. 2, showing a second prior art approach for joining metal and ceramic shafts.
Figure 4:
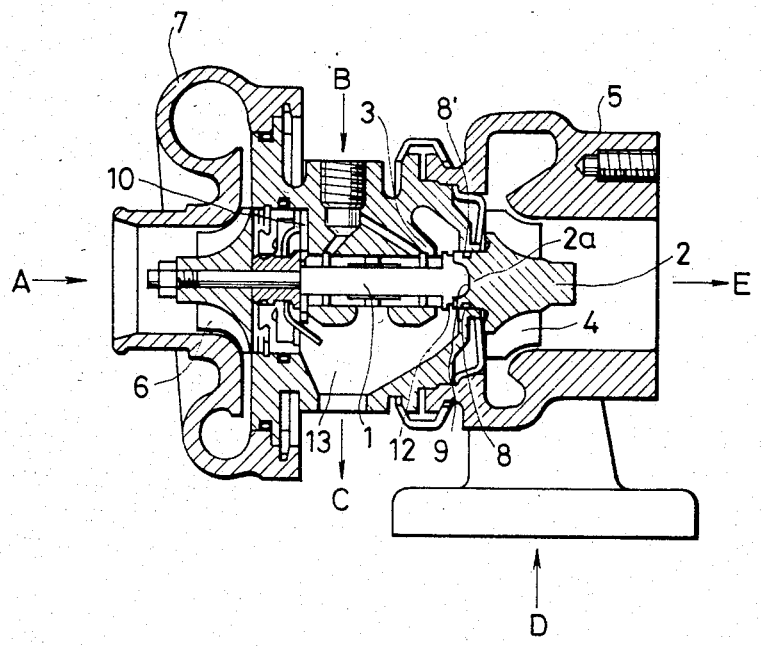
FIGS. 4 and 5 show first and second embodiments of a turbine constructed in accordance with the invention.

Referring now to FIG. 4, a first preferred embodiment of a turbine constructed in accordance with the teachings of the present invention will be described. In FIG. 4, and in FIG. 5 as well, reference numerals and characters used in common in FIGS. 1 through 3 designate like or similar components.

As in the conventional arrangement, the shaft 1 of the turbine is made of metal and the rotor 2, including the straight portion 2*a* thereof, is made of a ceramic material. In accordance with the invention, the juncture 12 between the metal shaft 1 and the ceramic straight portion 2*a* lies between the bearing 3 and seal ring 8' and within a region in which lubricating oil from the reservoir 13 circulates. By so doing, the temperature of the juncture 12 is controlled and prevented from being excessively high, thereby preventing the brazed connection between the ceramic shaft 1 and ceramic rotor 2 from being broken due to thermally induced differences of expansion between these two members.

Figure 5:
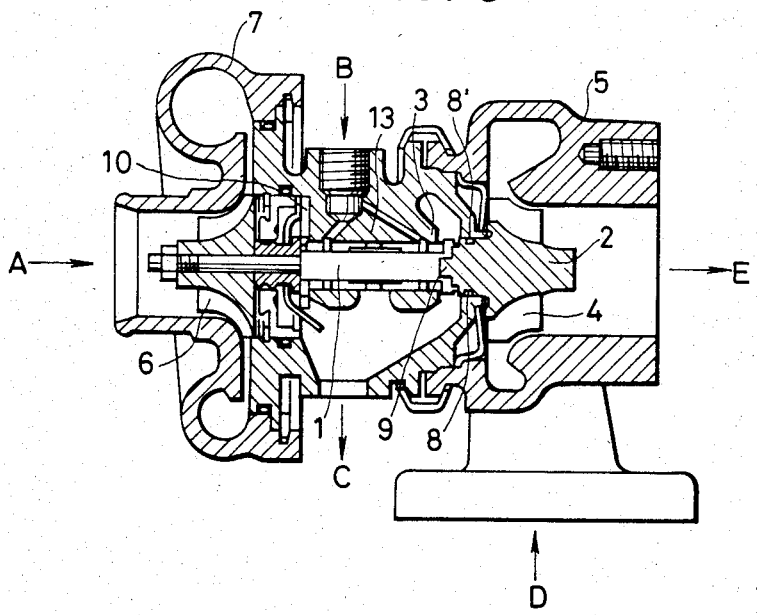

In the embodiment of FIG. 4, the end of the shaft 1 has a tapered cylindrical shape. This shape is advantageous in that air bubbles are prevented from being trapped in the space between the shaft 1 and rotor 2 when the two members are assembled. In the embodiment of FIG. 5, the end portion of the rotor 2 is made to project into a cup-like opening in the end of the shaft 1. This latter arrangement is advantageous in further lowering the temperature at the connection, and thereby further improving the reliability of the joint between the metal and ceramic members.

Figure 6A:
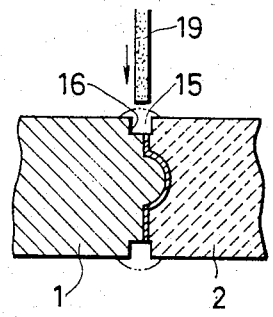
FIGS. 6A and 6B show steps in the fabrication of a turbine shaft of the invention.
Figure 6B:
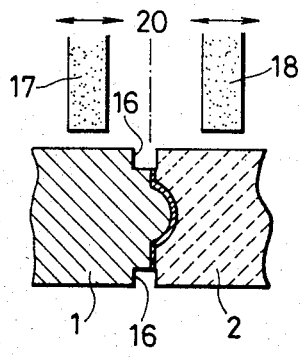

A preferred technique for making the connection between the shaft 1 and the rotor 2 will be described with reference to FIGS. 6A and 6B. First, as illustrated by FIG. 6A, the shaft and the rotor are coupled together by brazing or the like. The brazing operation results in excess brazing material 15 being deposited at the outer peripheral ends of the shaft and the rotor. To form an annular groove 16, a single grinder 19 is preferably used as indicated by the arrow in FIG. 6A. Then, it is desirable to use two different grinding tools 17 and 18, as shown by the traverse arrows in FIG. 6B. The reason for using two different tools is that a tool suitable for grinding the metal of the shaft 1 is not suitable for grinding the ceramic material of the rotor 2. Either tool, can however be used to grind the residual brazing material 15. The rotating tool 17 is used to traverse-grind from the center line 20 at the brazing portion to the left as illustrated in FIG. 6B to grind the outer peripheral surface of the shaft as well as the excess portion 15, while the rotating tool 187 is used to grind from the center line 20 rightwardly to grind outer peripheral surface of the rotor 2 as well as the excess portion. Upon forming flush surface along the shaft, brazed part and the rotor, a groove 16 has been already formed by the grinder 19 at the outer peripheral end of the shaft portion, as illustrated in FIG. 6A. The presence of the groove 16 is advantageous in that it acts as an oil-blocking groove, thereby enhancing the circulation of oil around the juncture 12 between the shaft 1 and rotor 2, and thus serving as a liquid seal. In addition, this groove 16 is effective for traverse-grinding of the different materials, since the excessive traversing movements of the grinders can be prevented.

This completes the description of the preferred embodiments of the invention. Although preferred embodiments have been described, it is believed that numerous modifications and alterations thereto would be apparent one of ordinary skill in the art without departing from the spirit and scope of the invention.

We claim:

1. In a turbine having a ceramic rotor joined to a metal turbine shaft, the improvement wherein: a juncture between said rotor and said turbine shaft is disposed between a bearing supporting said turbine shaft and a sealing ring blocking fluid flow around said rotor from an oil reservoir of said turbine, and at a position where oil from said oil reservoir is circulated around said juncture.

2. The improved turbine of claim 1, wherein a groove is formed around said juncture between said shaft and said rotor.

3. The improved turbine of claim 2, wherein said shaft has a tapered cylindrical portion extending into a mating cup-like end of said rotor.

4. The improved turbine of claim 2, wherein said rotor has an end projecting into a cup-like end of said shaft.

5. The improved turbine of claim 2, wherein said rotor and said shaft are joined by brazing.

* * * * *